US005908229A

United States Patent [19]

Wetherholt et al.

[11] Patent Number: 5,908,229

[45] Date of Patent: Jun. 1, 1999

[54] OUTER SHELL OF REFRIGERATOR CABINET

[75] Inventors: Steven Douglas Wetherholt; Martin Eric Wesemann, both of Franklin; Ronnie Charles Coffey; James E. Altmyer, both of Murfreesboro; Michael Wayne Austin, Mc Minnville, all of Tenn.

[73] Assignee: Whirlpool Corporation, Benton Harbor, Mich.

[21] Appl. No.: 08/956,487

[22] Filed: Oct. 23, 1997

[51] Int. Cl.[6] ..... A47B 96/04

[52] U.S. Cl. ..... 312/406.2; 312/401; 312/263

[58] Field of Search ..... 312/400, 401, 312/406, 406.1, 406.2, 257.1, 263

[56] References Cited

U.S. PATENT DOCUMENTS

| | | | |
|---|---|---|---|
| 2,450,844 | 10/1948 | Stuart . | |
| 2,522,097 | 9/1950 | Cookson | 312/263 X |
| 3,337,983 | 8/1967 | Ebstein | 312/263 X |
| 3,684,342 | 8/1972 | Jansen | 312/406.2 |
| 3,794,396 | 2/1974 | Vick | 312/406.2 |
| 4,077,686 | 3/1978 | Bukaitz | 312/257.1 |
| 4,296,982 | 10/1981 | Kullander | 312/257.1 |
| 4,296,983 | 10/1981 | Rogers et al. | 312/263 |
| 4,462,647 | 7/1984 | Key | 312/263 X |
| 4,580,852 | 4/1986 | Smitte et al. | 312/406.2 |
| 4,714,304 | 12/1987 | Sisk et al. | 312/406.2 |
| 4,750,794 | 6/1988 | Vegh | 312/263 |
| 5,221,131 | 6/1993 | Lesperance et al. | 312/263 |
| 5,720,536 | 2/1998 | Jenkins et al. | 312/401 X |

FOREIGN PATENT DOCUMENTS

| | | | |
|---|---|---|---|
| 787033 | 9/1935 | France | 312/406.2 |

*Primary Examiner*—Peter M. Cuomo
*Assistant Examiner*—James O. Hansen
*Attorney, Agent, or Firm*—Robert O. Rice; Thomas J. Roth; Andrea Powers Denklau

[57] ABSTRACT

An outer shell for a refrigerator a cabinet formed from a plurality of vertically arranged panels each having opposed vertical edges, a top edge and a bottom edge. A plurality of dovetail-like, linear joints interlock the vertical edges of the vertically arranged panels without requiring additional fasteners or welding. A top panel is interconnected with the top edges of the vertically arranged panels and a bottom panel is interconnected with the bottom edges of the vertically arranged panels. Each of the linear joints comprise a channel having a fan shaped cross-section provided along one edge of a panel and a connecting flange formed along the edge of a second adjacent panel wherein the connecting flange is received into the channel such that the first and second panels are interconnected. The outer shell is easily assembled by joining adjacent panels via the interlocking joints. Moreover, the joints provide strength to the outer shell and are well suited for use in insulation foaming.

9 Claims, 4 Drawing Sheets

OUTER SHELL OF REFRIGERATOR CABINET

BACKGROUND OF THE INVENTION

1. Field of the Invention

The present invention relates generally to refrigerator cabinets, and more particularly, to an outer shell or wrapper of a refrigerator cabinet having a multi-panel configuration which is adapted to be assembled using interlocking, vertical joints.

2. Description of the Related Art

Conventional refrigerator cabinets include an outer shell and an inner liner disposed within and spaced inwardly from the outer cabinet. A body of insulation is disposed between the outer shell and the liner. In certain refrigerator cabinets, it is desirable to use an outer shell of wrap-around sheet metal construction, as shown in U.S. Pat. No. 2,450,844 to Stuart. Other refrigerators use a three sided wrapper in combination with a rear panel to form the outer shell of a refrigerator, as shown in U.S. Pat. No. 4,580,852, to Smitte et al.

It is difficult to form refrigerator cabinet shells of the type shown in the '844 and '852 patents for large capacity built-in refrigerators having refrigeration components mounted on top of the cabinet. These types of wrap-around sheet metal shells are not only difficult to form in large sizes but they may not provide the cabinet strength necessary for a large built-in refrigerator. Accordingly, refrigerator cabinet shells may be fabricated from more than one panel. U.S. Pat. No. 4,714,304, for example, discloses a refrigerator cabinet including an outer shell formed from three separate panels which are either welded together or assembled using separate fasteners.

Unfortunately, refrigerator cabinet shells, such as shown in the '304 patent, are relatively costly to manufacture because of the difficulty in assembling the separate panels into a single shell structure. Welding large metallic members along a lengthy seam is relatively difficult and costly and can lead to quality problems. The use of separate fasteners, such as rivet or screws, is similarly difficult and costly.

In-plant processing is another drawback to the prior art refrigerator shell designs. Because of the difficulty in assembling multi-panel shell designs, these shells are typically fabricated into an assembled shells at a remote assembly location and then conveyed to the refrigerator assembly line. These assembled shells are large, bulky items requiring a great deal of work-in-process storage space. It would be a significant improvement to provide a shell which could be quickly assembled directly at the refrigerator assembly line from panels which could be more easily stored prior to assembly such that the work-in-process storage requirements could be reduced.

An additional concern in fabricating refrigerator cabinet shells is to provide an assembled shell which has sufficient integrity such that the interconnections between the separate panels of the shell prevent insulation from escaping when foam insulation is introduced into the cavity formed between the shell and liner. It would be an improvement in the art to provide a shell design which could be easily assembled with interlocking joints which formed adequately sealed interconnections between adjoining panels such that insulation did not escape during the cabinet foaming process.

SUMMARY OF THE INVENTION

In accordance with the present invention, a refrigerator apparatus is provided with a cabinet having an outer shell formed from a plurality of vertically arranged panels each having opposed vertical edges, a top edge and a bottom edge. A plurality of linear joints interlock the vertical edges of the vertically arranged panels without requiring additional fasteners or welding. A top panel is interconnected with the top edges of the vertically arranged panels and a bottom panel is interconnected with the bottom edges of the vertically arranged panels. Each of the linear joints comprise a fan shaped channel provided along one edge of a panel and a connecting flange formed along the edge of a second adjacent panel wherein the engaging flange is received into the channel such that the first and second panels are interconnected.

DESCRIPTION OF THE PREFERRED EMBODIMENT

Figure 1:
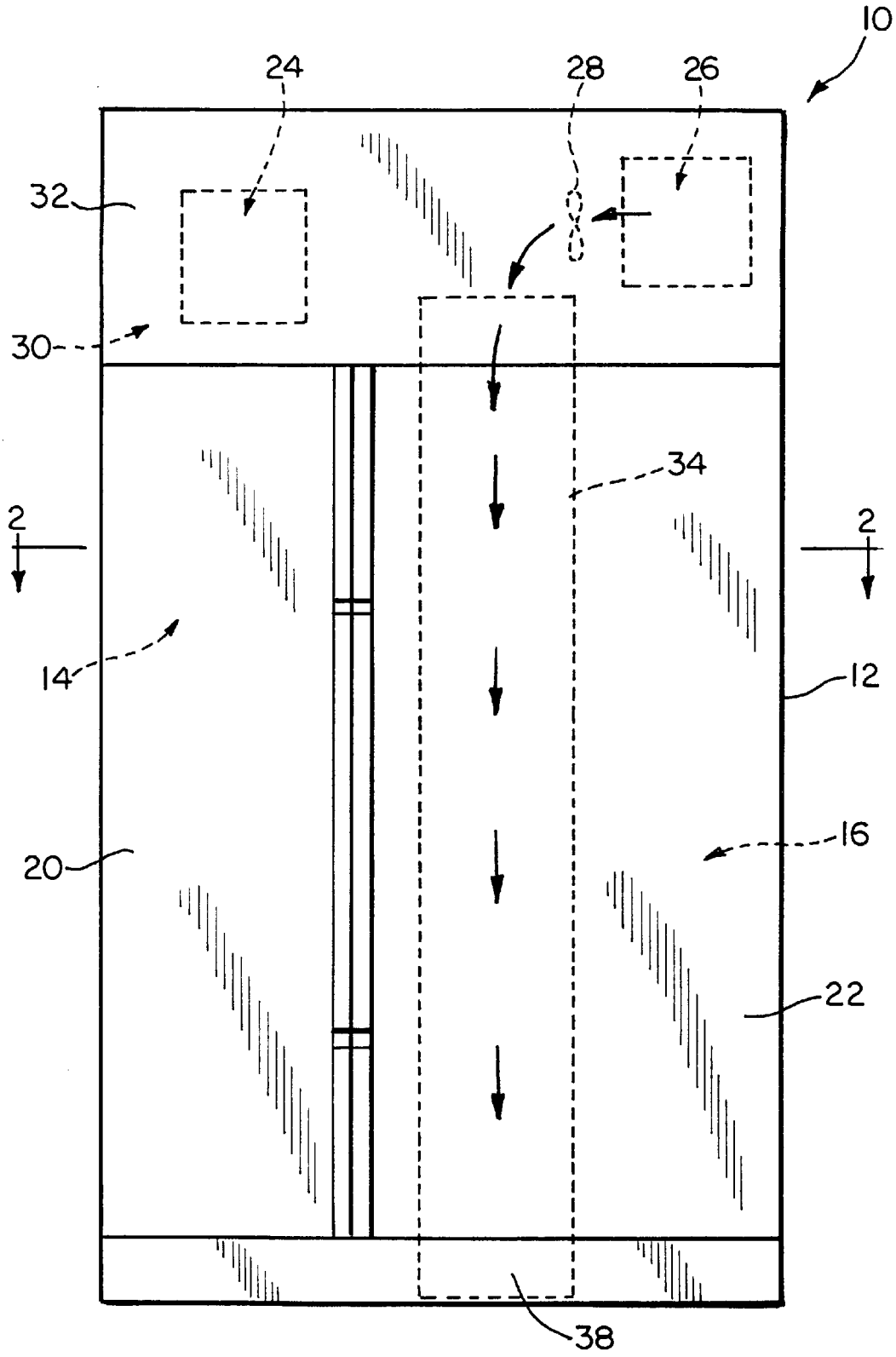
FIG. 1 is a front elevational view of a refrigerator having an outer shell construction embodying the present invention.
Figure 2:
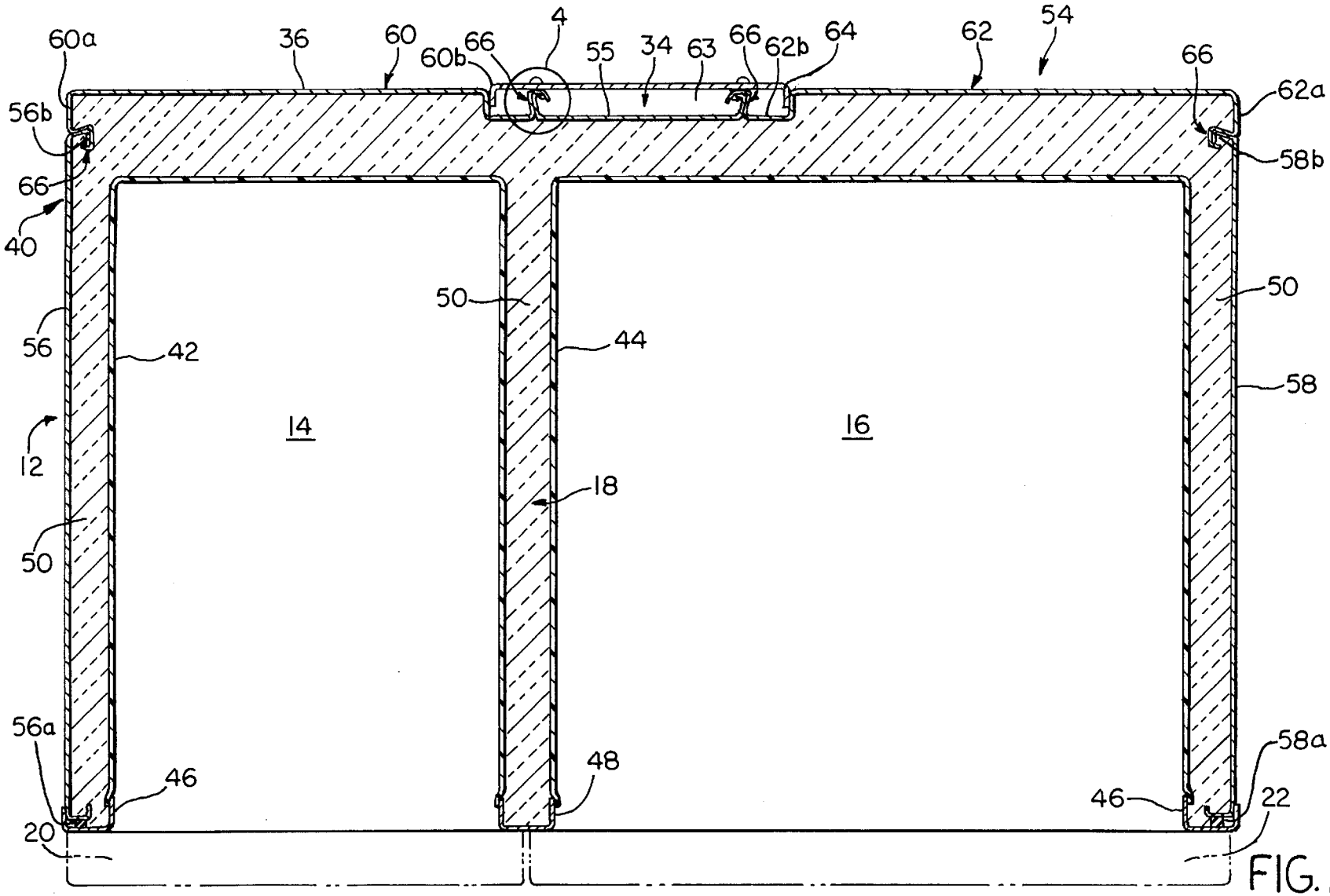
FIG. 2 is a sectional view taken along lines 2—2 of FIG. 1.

Referring to FIGS. 1 and 2, a refrigeration apparatus such as a refrigerator 10 includes a cabinet 12 which defines a below freezing, or freezer, compartment 14 and a fresh food compartment 16 separated by a vertical divider wall 18 (FIG. 2). A freezer door 20 and a fresh food door 22 are provided for selective access to the freezer and fresh food compartments 14 and 16, respectively. The configuration of the refrigerator is similar in many respects to the disclosure of U.S. Pat. No. 4,714,304 to Sisk et al., the specification of which is hereby incorporated by reference.

The freezer and fresh food compartments 14 and 16 are cooled by circulating air therethrough which has been refrigerated as a result of being passed in heat exchange relationship with a conventional evaporator (not shown). In addition to the evaporator, the refrigeration system includes such components as a compressor 24, a condenser 26 and a condenser fan 28 as will be obvious to those skilled in the art. The compressor 24, the condenser 26 and the condenser fan 28 are all disposed within an upper machine compartment 30 of the refrigerator/freezer 10. A louvered front panel 32 overlying the machine compartment 30 provides an inlet for ambient air which will be drawn across the condenser 26 by the condenser fan 28. Heated air drawn off the condenser 26 by the condenser fan 28 is partially discharged down an inwardly extending air passageway, or a rear air duct, 34 which extends down a back wall 36 (FIG. 2) of the cabinet 12. The heated air is passed over a defrost water pan (not shown) and is subsequently discharged out through a bottom opening 38.

Referring to FIG. 2, the cabinet 12 includes an outer wrapper or shell 40, a freezer liner 42 and a fresh food liner 44. Outer wall breaker strips 46 extend between the front edges of the liners 42, 44 and the outer shell 40. An additional outer wall breaker strip 48 extends between the freezer liner 42 and the fresh food liner 44. A body of insulation 50 is disposed between the liners 42, 44 and the outer shell 40. The insulation is preferably foam insulation that is blown into the cavity defined between the liners 42, 44 and the shell 40 and subsequently hardens to provide insulation and rigidity to the cabinet 12.

Figure 3:
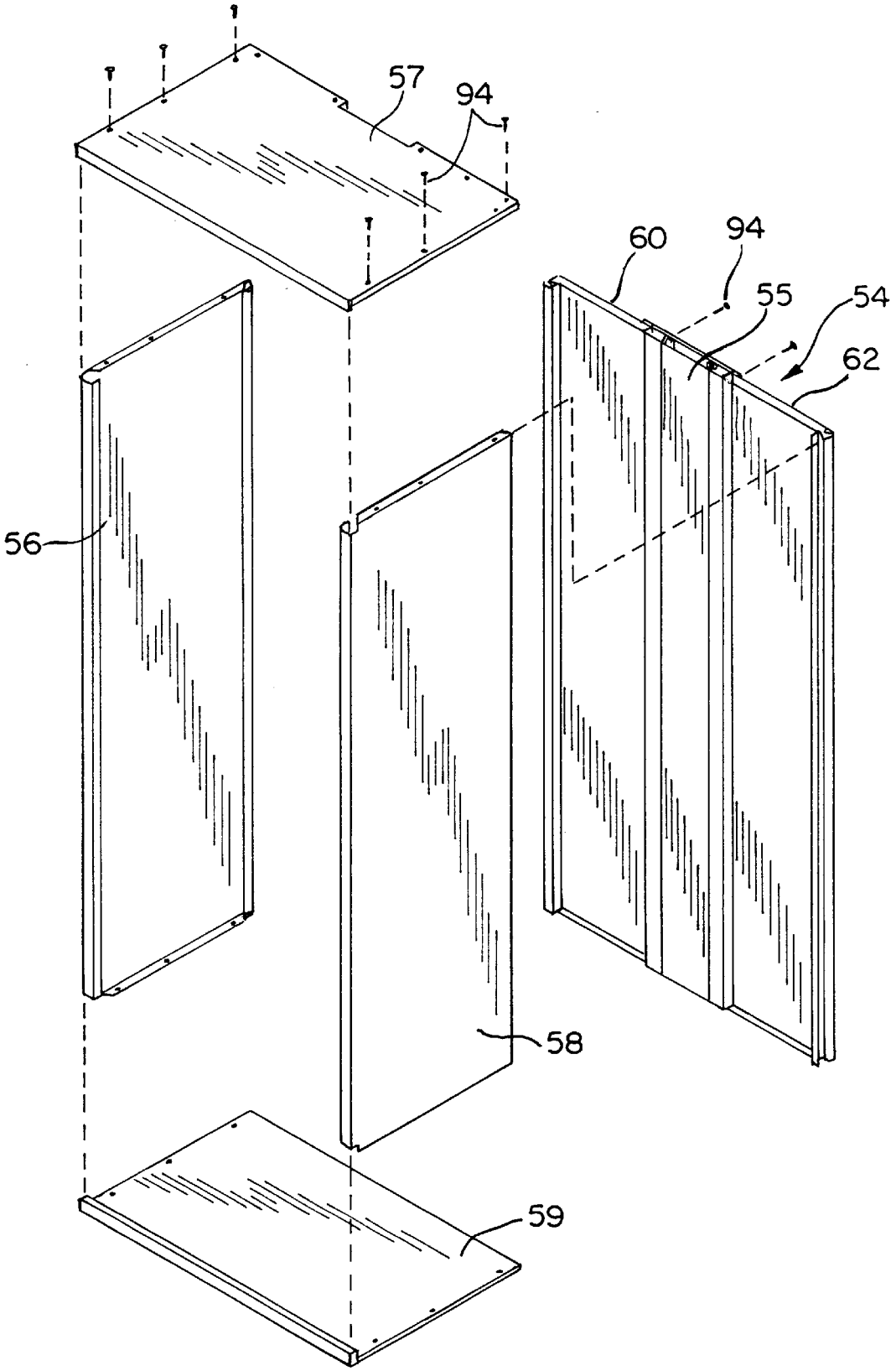
FIG. 3 is an exploded, perspective view of the outer shell of the refrigerator of FIG. 1.

Looking now at FIGS. 2 and 3, it can be seen that the outer wrapper 40 includes a back panel assembly 54, a left side panel 56, a right side panel 58, a top panel 57 and a bottom panel 59. The back panel assembly 54 forms the back wall 36 and comprises a right back panel 62, a left back panel 60 and a rear center panel 55. In the preferred embodiment all of the panels 56, 55, 58, 57, 59, 60 and 62 are manufactured of sheet metal and all of them are substantially planar such that they may be easily stacked during work-in-process storage. The side panels 56, 58 are formed having a front edge 56*a*, 58*a* and a rear edge 56*b*, 58*b*. The front edges 56*a*, 58*a* interconnect with the breaker strips 46. Each of the back panels 60, 62 are formed having a first edge portion 60*a*, 62*a* and a second edge portion 60*b*, 62*b*. The rear center panel 55 is disposed between the second edge portions 60*b*, 62*b*. The center panel 55 and the second edge portion 60*b*, 62*b* form a rearwardly opening recess 63. A sheet metal cover 64 is secured to overlie the recess 63 thereby defining the duct 34.

A plurality of linear joints 66 are provided for joining the separate panels 55, 56, 58, 60, 62 of the outer wrapper 40. In particular, each joint 66 is provided between the rear edges 56*b*, 58*b* and the first edge portion 60*a*, 62*a* and between the second edge portions 60*b*, 62*b* and the side edges of the rear center panel 55. It is preferably contemplated that each joint 66 is substantially identical.

It can be seen, therefore, that the outer shell 40 includes a plurality of joints 66 and a rear air duct 34 such that the cabinet 12 is provided with great structural rigidity. The joints 66 provide internal columns of considerable strength to support the refrigeration components disposed in the upper compartment 30. The cross sectional shape of the joints increase the cabinets resistance to bending and twisting.

Figure 4:
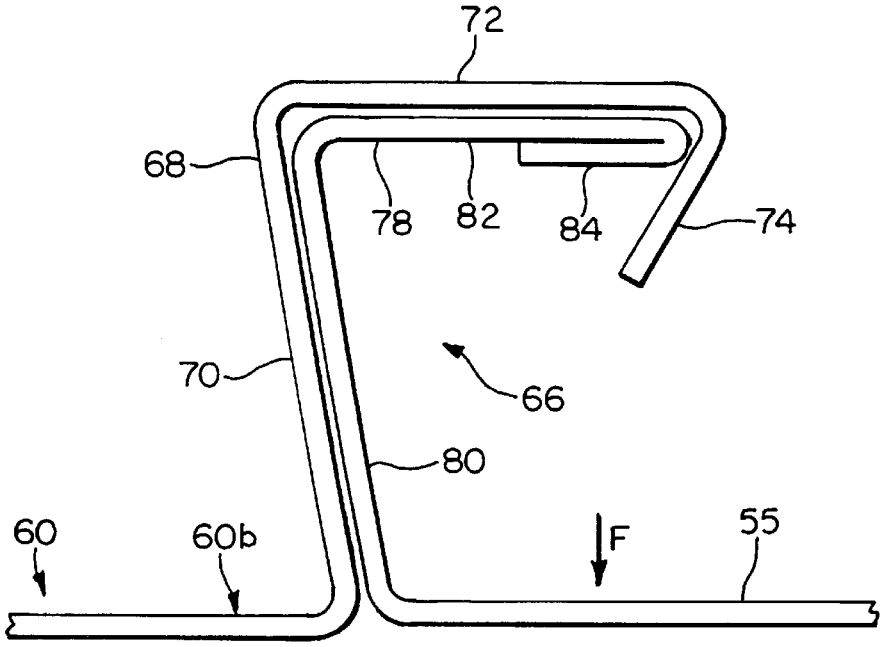
FIG. 4 is an enlarged view of circled area 4 of FIG. 2, showing one of the interlocking joints of the outer shell.

FIG. 4 illustrates details of the linear joint 66 between the second edge portion 60*b* and the side edge of the center panel 55. The linear joint 66 is illustrative of all the joints connecting the various panels. A channel 68 having a fan shaped cross section is provided along the second edge portion 60*b*. The fan shaped channel 68 is formed by a first flange 70, a joining flange 72 and a lip 74. The first flange 70 is formed at an angle greater than 90° from the edge portion 60*b* to extend away from the edge portion 60*b* at an acute angle. The joining flange 72 extends away from the first flange in a direction away from the edge portion 60*b*. The lip 74 extends from the joining flange back generally toward the center panel 55. The lip 74 is bent over at an acute angle from the joining flange 72. The first flange 70 and the lip 74 form opposed bearing surfaces that help resist separation of the panels from forces directed outwardly from the panels.

Extending along the side edge of the center panel 55 is a connecting flange 78 which is received into the channel 68 such that the back panel 60 and the center panel 55 are interlocked. The connecting flange 78 is preferably formed by a first flange 80 formed at an angle less than 90° from the center panel 55 to extend away from the center panel 55 at an obtuse angle. A second flange 82 is bent over from the first flange 80 to extend back in the direction of the second panel such that the second flange 82 overlies the edge of the center panel 55. The connecting flange 78 may also include a rolled over edge portion 84, shown rolled over 180° but which may be rolled over to a lesser extent. Alternatively, the rolled over edge portion 84 could be a bent over flange extending away from the center panel.

The channel 68 having a fan-shaped cross section with opposed bearing surfaces functions as a mortise-like member which receives the connecting flange 78 which functions as a tenon-like member. The opposed bearing surfaces of the fan shaped cross-section of the joints 66 are critical to ensure that the panels which form the outer wrapper 40 are securely interconnected. Specifically, the bearing surfaces contact the first flange 80 and the end of the second flange 82 or the bent over flange 84 (or its equivalent) if used, to resist the removal of the interlocked connecting flange from the channel 68 in response to a lateral force F; thus preventing the separation of the connected panels. This is an improvement over previous designs where only lip 74 is slanted which provided a less secure interlock.

The channel 68 is bent using a CNC Panel Bender. It is not as economically feasible or ergonomically correct to make the bends to form the channel 68 with a traditional bending apparatus because flange 70 and lip 74 are bent toward each other.

In addition to providing a uniquely secure joint, the joints 66 provide a joint having a serpentine interface of abutting flanges such that during cabinet foaming, insulation does not escape past the joint. In particular, each joint 66 has abutting flanges 70, 80 and the joining flange 72 abuts the second flange 82 wherein the interface between these abutting faces 70, 80 and 72, 82 prevents foam leakage.

Figure 5:
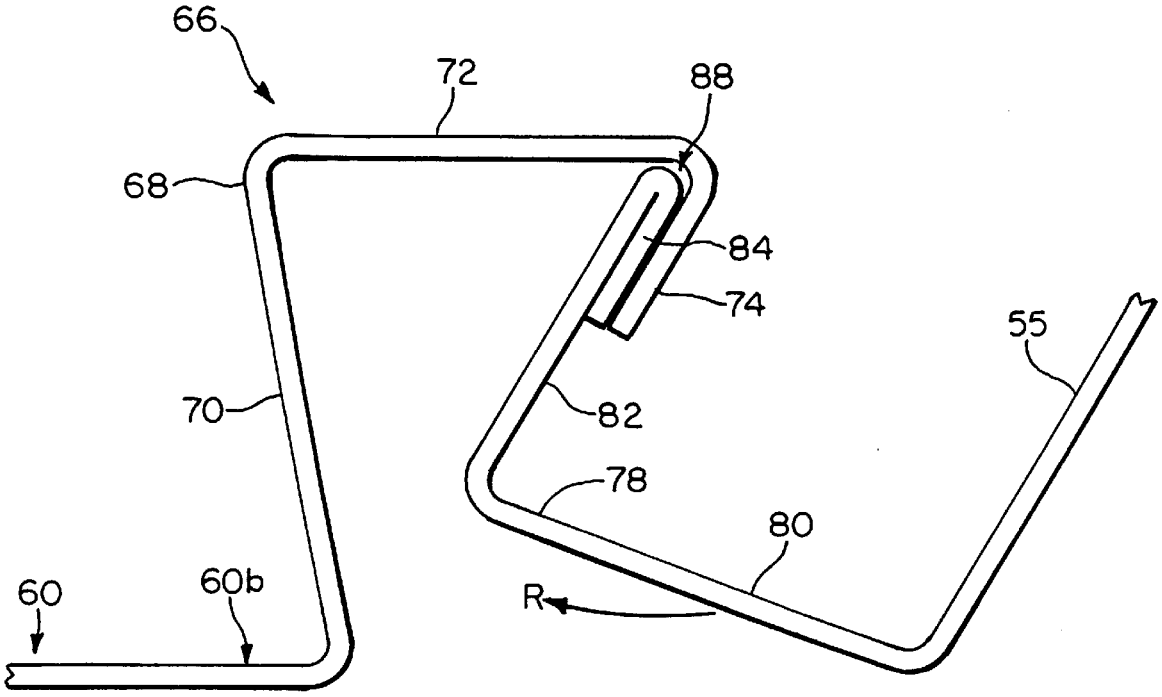
FIG. 5 is an enlarged view of one of the interlocking joints of the outer shell prior to being positioned in a fully locked orientation.

FIG. 5 illustrates the preferred manner of locking together adjacent panels of the outer shell 40. As in FIG. 4, the joint between the center panel 55 and the back panel 60 is used for illustration. While the back panel 60 and the center panel 55 are oriented in a non-coplanar relationship, the edge of the second flange 82 is located into a corner 88, defined by the intersection between the lip 74 and the joining flange 72, of the channel 68. The center panel 55 is then rotated in direction R such that the connecting flange 78 pivots within the channel 68 until the panel 55 is co-planar with the back panel 60 and a fully locked position is reached in which the first flanges 70, 80 and the joining flange 72 and the second flange 82 abut (as shown in FIG. 4).

The above described outer shell 40 offers a significant benefit over prior art outer shells in that it may be assembled easily without need for any welding or riveting. The panels of the shell are also better interlocked because of the opposed bearing surfaces, which prevent the separation of the panels in response to a lateral force F. During the manufacturing process, the outer shell 40 is formed by first assembling the back panel assembly 54. Accordingly, the first the left back panel 60 is connected to the center panel 55 and then the right back panel 62 is connected to the center panel 55. They are assembled such that the inner surface 92 of the back panel assembly 54 faces upwardly. Subsequently, the side panels 56, 58 are engaged with the channels 68 provided along the first edge portions 60*a*, 62*a* and rolled up to a locked position. To complete the shell 40, the top panel 57 and a bottom panel 59 are then attached to the top and bottom edges, respectively, of the side panels 56, 58 the rear panels 60, 62, and the center panel 55 via threaded fasteners 94 or rivets (see FIG. 3).

To meet the demand for different capacity refrigerators, the width of the cabinet 12 may be varied for different refrigerator models. This variety in cabinet width may preferably be provided by changing only the back panels 60, 62 such that the number of different parts which require fabrication and inventory is kept to a minimum. For example, for an outer shell having a width of 36" as compared to an outer shell having a width of 30", only the back panels 60, 62, the top panel 57 and the bottom panel 59 need to be changed.

It can be seen, therefore, that the present invention provides for an easily assembled refrigerator shell which has great beam strength and is well suited for insulation foaming. While the present invention has been described with reference the above described embodiments, those of skill in the Art will recognize that changes may be made thereto without departing from the scope of the invention as set forth in the appended claims.

We claim:

1. An outer shell of a refrigerator cabinet, comprising:

at least two vertically arranged panels each having opposed vertical edges, a top edge and a bottom edge;

a top panel interconnected with the top edges of the vertically arranged panels;

a bottom panel interconnected with the bottom edges of the vertically arranged panels;

a linear joint for interlocking the opposed vertical edges of the vertically arranged panels without requiring additional fasteners or welding the linear joint comprising:

a channel having opposed bearing surfaces and being formed along the edge of a first of the at least two panels; the channel comprising:

a first flange bent up to extend away from the first panel at an acute angle and defining one of the opposed bearing surfaces, a lip extending back generally toward the first panel and defining another of the opposed bearing surfaces, and a joining flange connecting the first flange with the lip;

a connecting flange formed along the edge of a second of the at least two panels wherein the connecting flange is received into the channel such that the first and second panels are interconnected and the flange bears against the opposed bearing surfaces in response to a lateral force; the connecting flange comprising:

a first flange bent up to extend away from the second panel at an obtuse angle, and a second flange extending away from the first flange back in the direction of the second panel, wherein the connecting flange is received into the channel such that the first and second panels are interconnected and at least a portion of the first flange and second flange of the connecting flange bear against the opposed bearing surfaces.

2. The refrigerator outer shell according to claim 1, further wherein the connecting flange has an L-shaped cross-section which fits within the channel.

3. The refrigerator outer shell according to claim 2, further wherein the connecting flange has a fan-shaped cross-section for fitting within the channel.

4. The refrigerator outer shell according to claim 1, further comprising an edge portion connected to the connecting flange and at least a portion of the edge portion bears against one of the bearing surfaces in response to the linear force.

5. The refrigerator outer shell according to claim 4, wherein the edge portion is rolled over the second flange.

6. The refrigerator outer shell according to claim 1, wherein:

the outer shell has a generally U-shaped cross-section with a right rear corner and a left rear corner, and a plurality of linear joints such that each rear corner is provided with a linear joint for enhancing the compressive strength of the cabinet.

7. An outer shell for a refrigerator cabinet, comprising:

a back panel assembly having a right side vertical edge and a left side vertical edge, the back panel assembly including:

a right back panel having a first edge portion and a second edge portion, a center panel having a first side edge portion and a second side edge portion, a left back panel having a first edge portion and a second edge portion, where in the center panel is interconnected between the right rear panel by a right interlocking linear joint and the left rear panel by a left interlocking linear joint;

a right side panel connected to the back panel assembly along its right side vertical edge by an interlocking linear joint;

a left side panel connected to the back panel assembly along its left side vertical edge by an interlocking linear joint; and the linear joints comprising:

a channel having opposed bearing surfaces and formed a long the edge of one of the panels; and a connecting flange formed along the edge of another of the panels wherein the connecting flange is received into the channel such that the panels are interconnected and the flange bears against the opposed bearing surfaces in response to a lateral force.

8. The refrigerator outer shell according to claim 7, wherein the interlocking linear joints which connect the center panel to the right and left back panels and the back panel assembly to the right and left side panels require no fasteners or connecting means such as welding.

9. An outer shell for a refrigerator cabinet, comprising:

a back panel assembly having a right side vertical edge and a left side vertical edge, the back panel assembly including:

a right back panel having a first edge portion and a second edge portion, a center panel having a first side edge portion and a second side edge portion a left back panel having a first edge portion and a second edge portion, wherein the center panel is interconnected between the right rear panel by a right interlocking linear joint and the left rear panel by a left interlocking linear joint;

a right side panel connected to the back panel assembly along its right side vertical edge by an interlocking linear joint;

a left side panel connected to the back panel assembly along its left side vertical edge by an interlocking linear joint; and the linear joints comprising:

a channel having opposed bearing surfaces and being formed along the edge of one of the panels; and the channel comprising:

a first flange bent up to extend away from the first panel at an acute angle, a lip extending back generally toward the first panel, and a joining flange connecting the first flange with the lip; and a connecting flange formed along the edge of another of the panels wherein the connecting flange is received into the channel such that the panels are interconnected and the flange bears against the opposed bearing surfaces in response to a lateral force; and the connecting flange comprises:

a first flange bent up to extend away from the second panel at an obtuse angle, and a second flange extending away from the first flange back in the direction of the second panel.

* * * * *